US008910315B1

(12) United States Patent
Stephens

(10) Patent No.: US 8,910,315 B1
(45) Date of Patent: Dec. 16, 2014

(54) GARMENT TO ASSIST A PERSON IN CARRYING OBJECTS

(71) Applicant: Ravi Lorenzo Stephens, Denver, CO (US)

(72) Inventor: Ravi Lorenzo Stephens, Denver, CO (US)

( * ) Notice: Subject to any disclaimer, the term of this patent is extended or adjusted under 35 U.S.C. 154(b) by 13 days.

(21) Appl. No.: 13/675,157

(22) Filed: Nov. 13, 2012

Related U.S. Application Data

(60) Provisional application No. 61/598,766, filed on Feb. 14, 2012.

(51) Int. Cl.
*A41D 1/04* (2006.01)

(52) U.S. Cl.
CPC ..... *A41D 1/04* (2013.01)
USPC ..... 2/102

(58) Field of Classification Search
USPC ..... 2/102, 94, 95
See application file for complete search history.

(56) References Cited

U.S. PATENT DOCUMENTS

| | | | | | |
|---|---|---|---|---|---|
| 796,711 | A | * | 8/1905 | Ferguson | 2/94 |
| 1,126,817 | A | * | 2/1915 | Meltsner | 2/95 |
| 1,385,224 | A | * | 7/1921 | Orr | 224/601 |
| 1,723,214 | A | * | 8/1929 | Smith | 2/94 |
| 2,315,416 | A | * | 3/1943 | Grady | 2/94 |
| 2,485,442 | A | * | 10/1949 | Halliday | 2/94 |
| 2,534,335 | A | * | 12/1950 | Berman | 2/94 |
| 2,717,391 | A | * | 9/1955 | Bracken | 2/94 |
| 2,865,025 | A | * | 12/1958 | Hennessey | 2/94 |
| 2,873,449 | A | * | 2/1959 | Herbert | 2/94 |
| 3,354,470 | A | * | 11/1967 | Allen | 2/94 |
| 3,529,307 | A | * | 9/1970 | Belson et al. | 2/94 |
| 4,106,121 | A | * | 8/1978 | Belson | 2/102 |
| 4,177,877 | A | * | 12/1979 | Gallinati | 182/3 |
| 4,261,059 | A | * | 4/1981 | Spitz | 2/108 |
| 4,272,852 | A | * | 6/1981 | Bell | 2/94 |
| 4,369,526 | A | * | 1/1983 | Clutts | 2/51 |
| 4,637,075 | A | * | 1/1987 | Ingrisano et al. | 2/94 |
| 4,669,127 | A | * | 6/1987 | Swanson | 2/46 |
| 5,014,359 | A | * | 5/1991 | Hanson | 2/94 |
| 5,072,456 | A | * | 12/1991 | Elin | 2/94 |
| 5,075,900 | A | * | 12/1991 | Chittenden | 2/94 |
| 5,077,838 | A | * | 1/1992 | Senser | 2/69 |
| 5,101,515 | A | * | 4/1992 | Holt et al. | 2/94 |
| 5,211,321 | A | * | 5/1993 | Rodriguez | 224/604 |
| 5,247,707 | A | * | 9/1993 | Parker et al. | 2/102 |
| 5,265,782 | A | * | 11/1993 | McNamara | 2/94 |
| 5,294,030 | A | * | 3/1994 | Jollivette | 224/681 |
| 5,361,412 | A | * | 11/1994 | Perry | 2/69 |
| 5,440,761 | A | * | 8/1995 | Abrams et al. | 2/102 |
| 5,452,476 | A | * | 9/1995 | Jenks | 2/46 |
| 5,465,425 | A | * | 11/1995 | Crispin | 2/102 |
| 5,617,582 | A | * | 4/1997 | Burwell | 2/102 |

(Continued)

*Primary Examiner* — Amber Anderson
(74) *Attorney, Agent, or Firm* — Plager Schack LLP

(57) ABSTRACT

A garment can assist a user with transporting personal items. The garment comprises a vest that can be worn over one's shoulders. The vest further comprises a right breast mechanically coupled a left breast by an upper vest fastener, a lower vest fastener and a draw string to provide stability to the vest. The left breast is mechanically coupled to a left breast pocket and the right breast is mechanically coupled to a right breast pocket that can be used for storing items. The vest is further mechanically coupled to a pouch that does not impede a user's ability to walk and can further store personal items. In this manner the user can use the garment to transport the personal items in a stable manner without having the garment impede the user's ability to walk.

1 Claim, 2 Drawing Sheets

(56) References Cited

U.S. PATENT DOCUMENTS

| | | | | | |
|---|---|---|---|---|---|
| 5,644,794 | A | * | 7/1997 | Hull et al. | 2/102 |
| 5,718,000 | A | * | 2/1998 | Ost et al. | 2/69 |
| 5,794,264 | A | * | 8/1998 | Yuen | 2/93 |
| 5,810,699 | A | * | 9/1998 | Nadeau | 182/105 |
| 5,815,833 | A | * | 10/1998 | Kuo | 2/69.5 |
| 5,815,834 | A | * | 10/1998 | Bronson | 2/102 |
| 5,829,060 | A | * | 11/1998 | Falk et al. | 2/102 |
| 5,909,802 | A | * | 6/1999 | Puco et al. | 2/102 |
| 5,913,409 | A | * | 6/1999 | Test | 2/102 |
| 5,991,925 | A | * | 11/1999 | Wu | 2/102 |
| 6,029,270 | A | * | 2/2000 | Ost et al. | 2/2.5 |
| 6,047,404 | A | * | 4/2000 | Blanks, I | 2/69 |
| D426,937 | S | * | 6/2000 | Auster et al. | D2/830 |
| D429,060 | S | * | 8/2000 | Matthias | D2/830 |
| 6,105,170 | A | * | 8/2000 | Lisciandro et al. | 2/102 |
| 6,131,199 | A | * | 10/2000 | Bugel et al. | 2/102 |
| 6,295,650 | B1 | * | 10/2001 | Baacke | 2/94 |
| 6,314,578 | B1 | * | 11/2001 | Masuda et al. | 2/102 |
| 6,397,392 | B1 | * | 6/2002 | Wooley et al. | 2/102 |
| 6,405,378 | B1 | * | 6/2002 | Garner | 2/102 |
| 6,662,373 | B2 | * | 12/2003 | Frank | 2/94 |
| RE38,497 | E | * | 4/2004 | Falk et al. | 2/94 |
| 6,763,527 | B1 | * | 7/2004 | Rivoli et al. | 2/250 |
| 6,874,163 | B2 | * | 4/2005 | Marshall | 2/102 |
| 6,889,834 | B2 | * | 5/2005 | Ho | 206/373 |
| 7,387,225 | B2 | * | 6/2008 | Fox | 224/257 |
| 7,886,368 | B2 | * | 2/2011 | Hood | 2/102 |
| 8,087,095 | B2 | * | 1/2012 | Maier | 2/102 |
| 2001/0052142 | A1 | * | 12/2001 | Marcon | 2/102 |
| 2003/0101508 | A1 | * | 6/2003 | Marshall | 2/462 |
| 2003/0159194 | A1 | * | 8/2003 | Frank | 2/102 |
| 2004/0187183 | A1 | * | 9/2004 | Hautala | 2/24 |
| 2006/0248627 | A1 | * | 11/2006 | Austin et al. | 2/102 |
| 2006/0288466 | A1 | * | 12/2006 | Bucheit | 2/102 |
| 2007/0226871 | A1 | * | 10/2007 | Hood | 2/69 |
| 2007/0271674 | A1 | * | 11/2007 | Hellweg | 2/102 |
| 2007/0277283 | A1 | * | 12/2007 | Borowski et al. | 2/69 |
| 2008/0201816 | A1 | * | 8/2008 | Elliot | 2/51 |
| 2008/0301863 | A1 | * | 12/2008 | Goff et al. | 2/467 |
| 2011/0000944 | A1 | * | 1/2011 | Hood | 224/576 |
| 2011/0010818 | A1 | * | 1/2011 | Hood | 2/102 |
| 2011/0083248 | A1 | * | 4/2011 | Johson | 2/102 |
| 2011/0302703 | A1 | * | 12/2011 | Silverberg | 2/457 |
| 2012/0124713 | A1 | * | 5/2012 | Blauer et al. | 2/102 |
| 2012/0291179 | A1 | * | 11/2012 | Shea | 2/102 |
| 2013/0019379 | A1 | * | 1/2013 | Shadid | 2/84 |
| 2013/0167286 | A1 | * | 7/2013 | Hudson | 2/102 |

* cited by examiner

GARMENT TO ASSIST A PERSON IN CARRYING OBJECTS

CROSS REFERENCE TO RELATED APPLICATIONS

This application claims priority to U.S. Provisional Application 61/598,766 filed on Feb. 14, 2012.

FIELD OF THE INVENTION

This invention relates to items that can be worn over clothing, which can provide a user with additional storage.

BACKGROUND OF THE INVENTION

Prior to the disclosed invention, users had essentially two items for carrying a large number of items when grocery shopping. First is the shopping cart such as U.S. Pat. No. 2,196,914 issued to Goldman. Second is a hand held basket or bag. The present invention teaches another device that does this. Regardless, at some point the user will need to carry personal items from one location to another and the disclosed garment accomplishes this in a unique fashion.

Of course, the present invention is not limited to shopping and can be used for carrying tools, baby supplies or anything else.

BRIEF SUMMARY OF THE INVENTION

A garment can assist a user with transporting personal items. The garment comprises a vest that can be worn over one's shoulders. The vest further comprises a right breast mechanically coupled a left breast by an upper vest fastener, a lower vest fastener and a draw string to provide stability to the vest. The left breast is mechanically coupled to a left breast pocket and the right breast is mechanically coupled to a right breast pocket that can be used for storing items. The vest is further mechanically coupled to a pouch that does not impede a user's ability to walk and can further store personal items. In this manner the user can use the garment to transport the personal items in a stable manner without having the garment impede the user's ability to walk.

In some embodiments, the right breast is further mechanically coupled to a right swivel hook by a right swivel hook strap. The left breast is further mechanically coupled to a left swivel hook by a left swivel hook strap. This allows the user to hang the personal items from the left swivel hook and the right swivel hook. The right breast is immediately adjacent to a right back, while the right back is immediately adjacent to a left back and the left back is immediately adjacent to the left breast. The left back is mechanically coupled to a left back pocket and the right back is mechanically coupled to a right back pocket that can be used for storing additional items. The left breast is further mechanically coupled to an inner left breast pocket and the right breast is further mechanically coupled to an inner right breast pocket that can be used for storing additional items.

BRIEF DESCRIPTION OF THE SEVERAL VIEWS OF THE DRAWINGS

Figure 1:
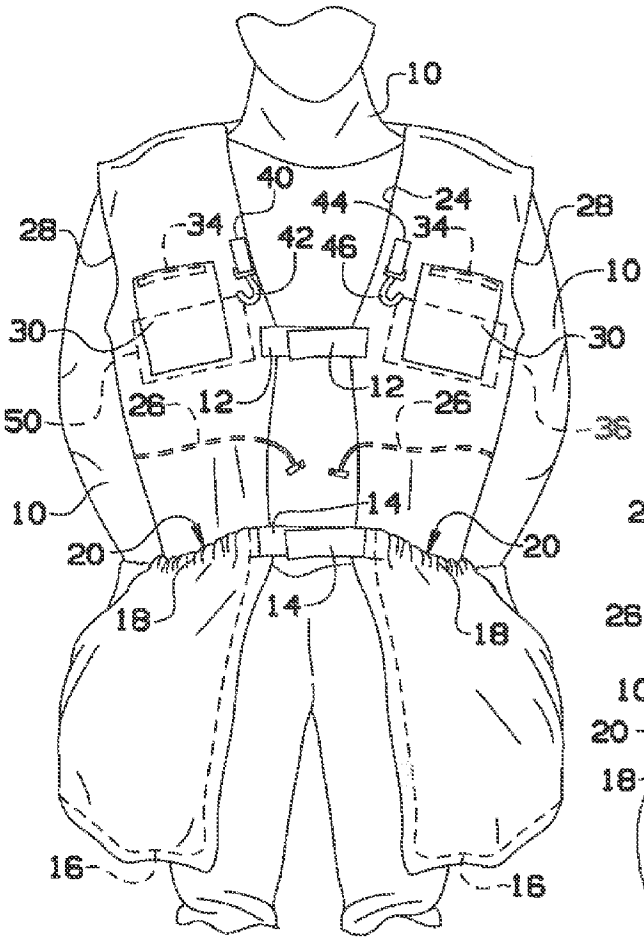

Having thus described the invention in general terms, reference will now be made to the accompanying drawings, which are not necessarily drawn to scale, and wherein:

FIG. 1 is a front view of the invention shown in use.

Figure 2:
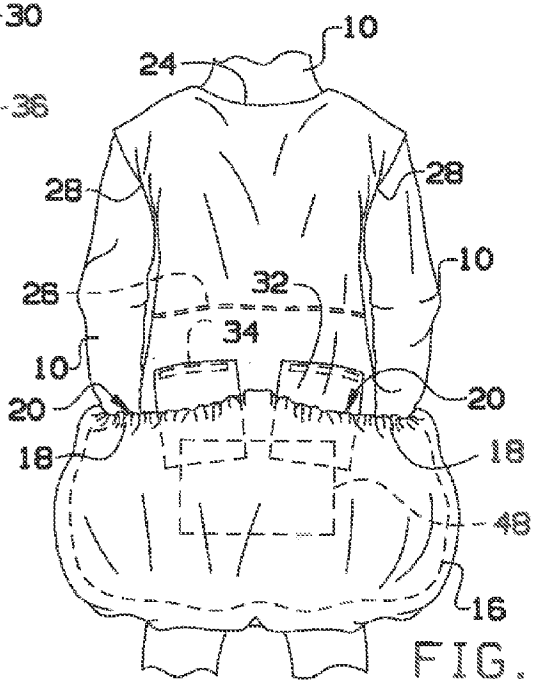

FIG. 2 is a back view of the invention shown in use.

Figure 3:
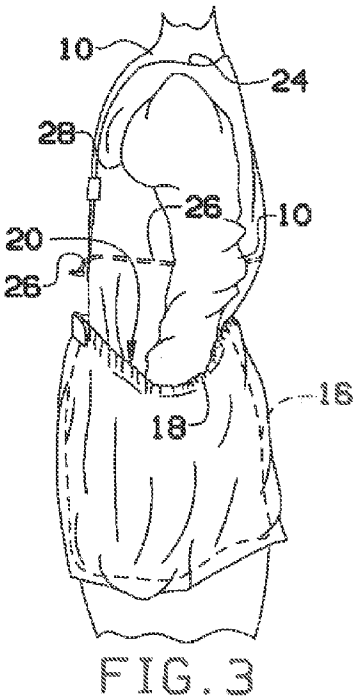

FIG. 3 is a side view of the invention shown in use.

Figure 4:
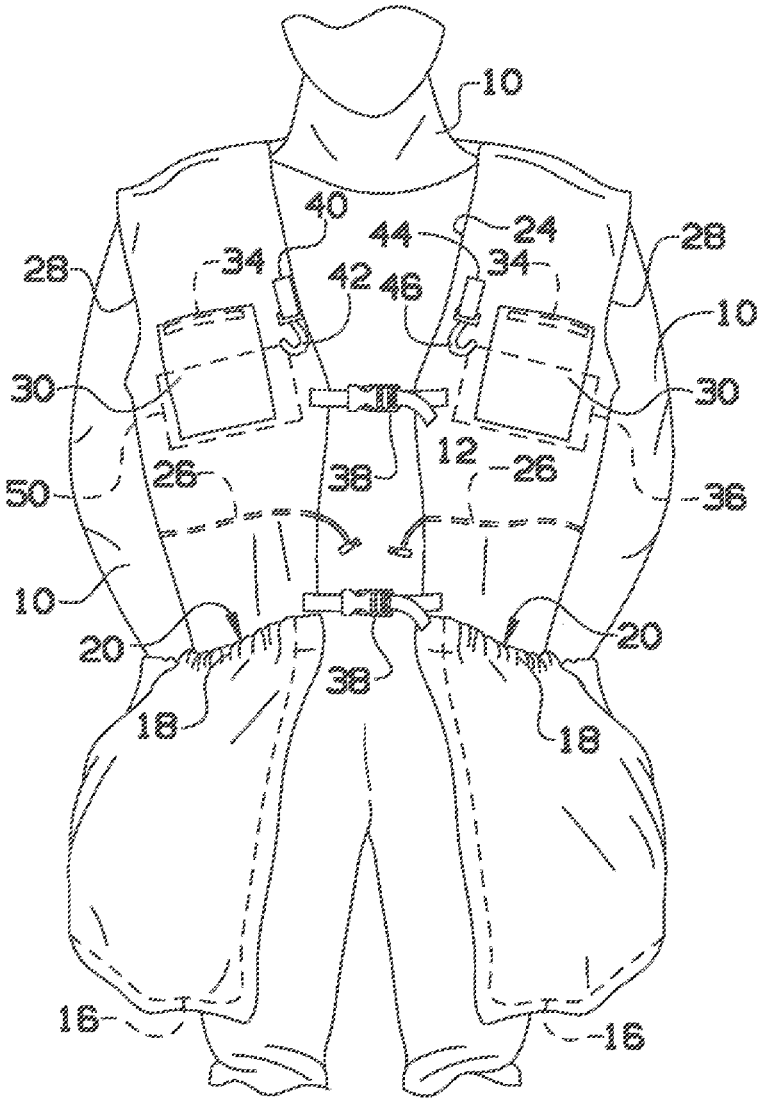

FIG. 4 shows a front view of an alternate embodiment of the invention in use.

DETAILED DESCRIPTION OF THE INVENTION

Embodiments of the present invention overcome many of the obstacles associated with carrying a large number of items with a single garment, and now will be described more fully hereinafter with reference to the accompanying drawings that show some, but not all embodiments of the claimed inventions. Indeed, the invention may be embodied in many different forms and should not be construed as limited to the embodiments set forth herein. Rather, these embodiments are provided so that this disclosure will satisfy applicable legal requirements. Like numbers refer to like elements throughout.

FIG. 1 and FIG. 3 show the garment for transporting personal items in use. User 10 would like to carry a large number of items in a garment while shopping. The garment has the shape of a vest with left arm opening 28 and right arm opening 28 which allows user 10 to wear the vest over one's shoulders. The vest has a solid back which wraps around to a right breast and a left breast mechanically coupled by upper vest fastener 12, lower vest fastener 14 and draw string 26. Here, upper vest fastener 12 and lower vest fastener 14 are hook and loop fasteners. Upper vest fastener 12, lower vest fastener 14 and draw string 26 provide additional stability for the vest. For instance, if a user loads one side of the vest down with an excessive number of personal items, the other side may rise and destabilize, but this can be prevented with upper vest fastener 12, lower vest fastener 14 and draw string 26 arranged between the left breast and the right breast which allows a user to transport personal items in a stable manner.

The left breast is mechanically coupled to left breast pocket 30 which can be accessed by opening left breast pocket hook and loop fastener 34. The left breast is further mechanically coupled to left swivel hook strap 44. Left swivel hook strap 44 is mechanically coupled to left swivel hook 46. The left breast can be further mechanically coupled to inner left breast pocket 36.

Likewise, the right breast is mechanically coupled to right breast pocket 30 which can be accessed by opening right breast pocket hook and loop fastener 34. The right breast is further mechanically coupled to right swivel hook strap 40. Right swivel hook strap 40 is mechanically coupled to right swivel hook 42. The left breast can be further mechanically coupled to inner left breast pocket 50.

Breast pockets 30, inner left breast pocket 36 and inner right breast pocket 50 provide spaces that a user can utilize to store personal items. Left swivel hook 46 and right swivel hook 42 can be used to hang personal items such as keys, a flashlight or a whistle among other items.

The bottom of the vest is mechanically coupled to pouch 16 by sewing. Pouch 16 can be accessed from the top by pulling elastic strap 18 away from the user exposing pouch 16. In this manner, pouch 16 solves a problem created in the art by a conventional apron, that is, an apron puts personal items to close to a user's thighs making it difficult to walk forward, the present invention teaches that personal items should be arranged in places that a user's ability to walk forward.

FIG. 2 shows a rear view of the vest. Neck opening 24 provides room for a user's neck and head without disrupting the rest of the vest. The left back is mechanically coupled to left back pocket 32 which can be accessed by opening left pocket hook and loop fastener 34. Likewise, the right back is mechanically coupled to right back pocket 32 which can be accessed by opening right back pocket hook and loop fastener 34. In some embodiments pouch 16 is mechanically coupled to rear pocket 48, which can provide additional storage. Much like breast pockets 30, back pockets 32 provide spaces that a user can utilize to store personal items.

FIG. 4 shows an alternate embodiment of the invention. Here, both upper vest fastener 12 and lower vest fastener 14 have been replaced with parachute buckles 38. A user may desire to user parachute buckles 38 when carrying heavier items and the release of upper vest fastener 12 and lower vest fastener 14 would be undesirable. In either case upper vest fastener 12 and parachute buckle 36 both add stability to the vest.

That which is claimed:

1. A garment can assist a user with transporting personal items; the garment consisting of:

a vest with a right arm opening and a left arm opening allowing the user to wear the vest over one's shoulders; the vest further comprises a right breast mechanically coupled a left breast by an upper vest fastener, a lower vest fastener and a draw string to provide stability to the vest;

the left breast is mechanically coupled to a left breast pocket and the right breast is mechanically coupled to a right breast pocket that can be used for storing items;

the vest is further mechanically coupled to a pouch at three points leaving a top portion of the pouch substantially open and unobstructed from above while attached to an outside of the garment to receive items into the pouch; wherein the pouch wraps around the entire lower circumference of the vest and terminates in a lower edge of the vest and does not impede a user's ability to walk and can further store personal items; in this manner, the user can use the garment to transport the personal items in a stable manner without having the garment impede the user's ability to walk;

the right breast is further mechanically coupled to a right swivel hook by a right swivel hook strap and the left breast is further mechanically coupled to a left swivel hook by a left swivel hook strap which allows the user to hang the personal items from the left swivel hook and the right swivel hook;

the vest is further mechanically coupled to a left back pocket configured to be partially covered by the pouch; the vest is further mechanically coupled to a right back pocket configured to be partially covered by the pouch;

the right breast is immediately adjacent to a right back; the right back is immediately adjacent to a left back and the left back is immediately adjacent to the left breast;

the left back is mechanically coupled to a left back pocket and the right back is mechanically coupled to a right back pocket that can be used for storing additional items; and the left breast is further mechanically coupled to an inner left breast pocket and the right breast is further mechanically coupled to an inner right breast pocket that can be used for storing additional items.

* * * * *